United States Patent [19]

Couwenberg et al.

[11] 4,277,720

[45] Jul. 7, 1981

[54] LOW-PRESSURE MERCURY VAPOR DISCHARGE LAMP

[75] Inventors: Winston D. Couwenberg; Albert Bouwknegt; Franciscus A. S. Ligthart; Jean J. Heuvelmans, all of Eindhoven, Netherlands

[73] Assignee: U.S. Philips Corporation, New York, N.Y.

[21] Appl. No.: 95,128

[22] Filed: Nov. 15, 1979

[30] Foreign Application Priority Data

Nov. 17, 1978 [NL] Netherlands ..... 7811351

[51] Int. Cl.[3] ..... H01J 61/16

[52] U.S. Cl. ..... 313/485; 313/226

[58] Field of Search ..... 313/226, 485–487

[56] References Cited

U.S. PATENT DOCUMENTS

| | | | |
|---|---|---|---|
| 3,886,393 | 5/1975 | Hinson | 313/226 X |
| 4,032,814 | 6/1977 | Shurgan et al. | 313/226 X |

*Primary Examiner*—Palmer C. Demeo
*Assistant Examiner*—Darwin R. Hostetter
*Attorney, Agent, or Firm*—Robert S. Smith

[57] ABSTRACT

Low-pressure mercury vapor discharge lamp having a relatively small discharge vessel containing as the buffer gas a rare gas mixture which is rich in helium, but which also comprises a quantity of one or more heavier rare gases, preferably crypton. The heavier rare gases increase the arc voltage.

3 Claims, 2 Drawing Figures

LOW-PRESSURE MERCURY VAPOR DISCHARGE LAMP

Figure 1:
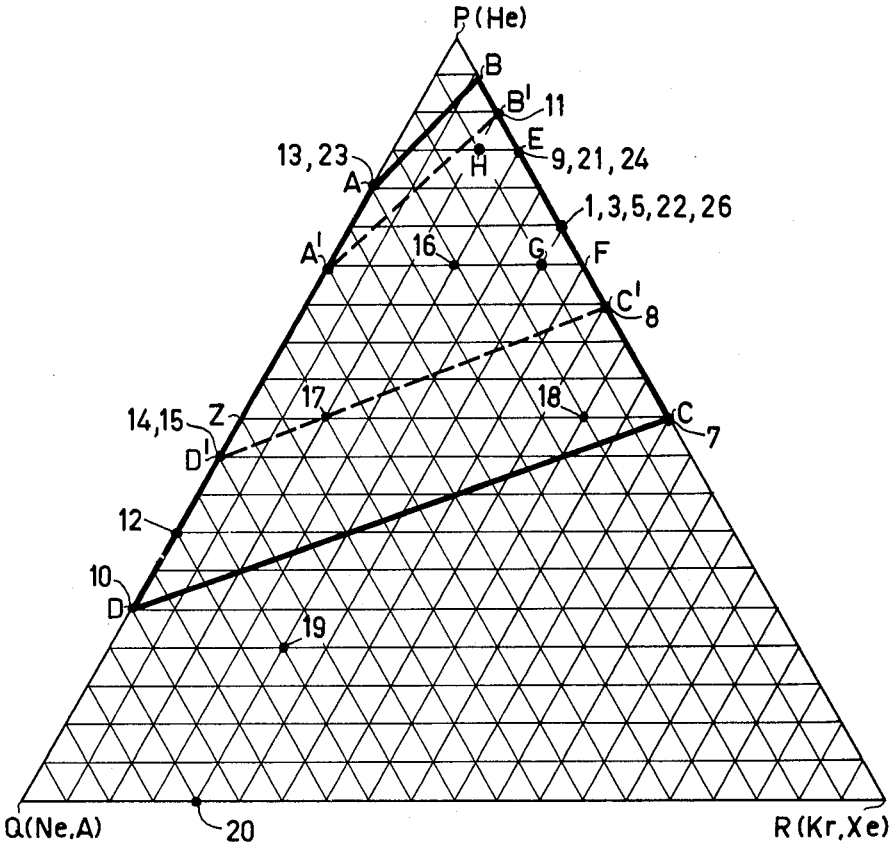

The invention relates to a low-pressure mercury vapor discharge lamp having a tubular discharge vessel, which is closed in a vacuum-tight manner, and having electrodes which are less than 40 cm apart, the inside diameter of this discharge vessel being less than 26 mm, and a luminescent layer provided on the inner wall surface of the discharge vessel, the discharge vessel containing mercury and a mixture of gases. Such a lamp is disclosed in German Offenlegungsschrift No. 2,109,898.

The small, compact types of lamps disclosed in this Offenlegungsschrift, to which a low electric power is supplied, are generally used in places where the usual tubular low-pressure mercury vapor discharge lamps having a length of approximately 120 cm are too big, such as night-lighting and emergency lighting systems, in small showcases, inspection lamps, etc.

One of the problems encountered when reducing the dimensions of low-pressure mercury vapor discharge lamps is that the efficiency of the lamp combined with the electric stabilization ballast which is essential for the operation of the lamp (the so-called system efficiency) is low compared with the system efficiency of the above-mentioned 120 cm long lamps.

In addition, the luminous flux of these compact lamps is relatively low. It might indeed be possible to increase the luminous flux of these lamps by increasing the lamp current but the result thereof is that the electric losses occurring in the electrodes and in the stabilisation ballast increase to a high value. The system efficiency then becomes unfavourable. In addition, the stabilisation ballast is then very bulky.

According to the above-mentioned German Offenlegungsschrift the lamp voltage can be increased by a further reduction of the diameter of the discharge vessel (so that for a given length of the discharge vessel the luminous efficiency becomes higher) but this has the drawback that blackening of the discharge vessel wall is accelerated. The above-mentioned German Offenlegungsschrift therefore proposes to give the discharge vessel near the electrodes a diameter, which is greater than the diameter of the portion located between the electrodes. It is then necessary to produce discharge vessels of a special shape for these lamps, however, and such vessels are relatively expensive to manufacture.

It is an object of the invention to provide a relatively short lamp having a high luminous flux, which lamp can be furthermore operated with such a current strength that the power consumed by the stabilization ballast is relatively low, so that the volume and the weight of that ballast are relatively small.

This object is accomplished by means of a lamp of the type defined in the opening paragraph which, according to the invention, is characterized in that the rare gas mixture in the discharge vessel comprises helium and at least one of the elements neon, argon, crypton and xenon, the composition of the rare gas mixture being representable by means of points located at or within a quadrilateral ABCD in a ternary composition diagram PQR in which P represents helium, Q neon and/or argon, and R crypton and/pr xenon, and wherein A indicates a mixture consisting of 80% by volume of helium and 20% by volume of neon and/or argon, B indicates a mixture consisting of 95% by volume of helium and 5% by volume of crypton and/or xenon, C indicates a mixture consisting of 50% by volume of helium and 50% by volume of crypton and/or xenon, and D indicates a mixture consisting of 25% by volume of helium and 75% by volume of neon and/or argon.

In the accompanying drawing FIG. 1 shows the ternary composition diagram PQR. Any mixture composed of rare gas combinations of (1) helium; (2) neon and/or argon; and (3) crypton and/or xenon can be represented by means of a point in this diagram. Mixtures comprising solely helium with argon and/or neon are found in the diagram along the side PQ. Thus point Z for example may represent a mixture consisting of 50% by volume of helium, 25% by volume of argon and 25% by volume of neon as well as a mixture consisting of 50% by volume of helium and 50% by volume of argon. Mixtures comprising solely helium with krypton and/or xenon are found along the side PR and the mixtures comprising solely neon and/or argon with krypton and/or xenon are found along the side QR. All other mixtures are located within the triangle PQR. A point within the triangle unambiguously indicates the percentage of helium in the different mixtures. The points located in the area at or within the quadrilateral ABCD indicate the compositions of the mixtures according to the invention.

If a known, relatively small lamp (comprising for example, only argon as the rare gas) is compared with a lamp of the same dimensions according to the invention, the luminous efficiency of the two lamps being the same the current in the known lamp will be considerably higher than in the lamp according to the invention. The efficiency of the conversion of electric power into ultraviolet radiation is indeed higher in the known lamp, but the lamp voltage (column voltage) in the known lamp is then so low, that, with the required applied power, a high current is necesary. In the lamp according to the invention the lamp voltage is on the contrary high, and the power required for a given luminous efficiency can be obtained with a considerably lower current, this resulting in low losses in the electrodes and in the stabilization ballast. This influences the system-efficiency in a favorable sense. The low value of the current in a lamp according to the invention makes it possible to obtain, with a lamp of the same dimensions as a known lamp, a comparable or even better system efficiency, the volume and the weight of the stabilization ballast being, however, considerably smaller.

Owing to the presence of the combination of rare gasses in a discharge vessel of the relatively small lamps according to the invention, the adverse effects which usually occur during the life of the lamp when helium is added, such as sputtering of the emitter material from electrodes, hardly occurs. It appears that the addition of a quantity of a heavier rare gas to the helium (which contributes most towards the high arc voltage in the discharge vessel) has a protective action on the electrodes. If the added quantity of the heavier rare gas is too low, the cathode drop (that is to say the voltage drop near the electrode surface area) will achieve such a high value that the electrodes will be rapidly corroded in the course of operation of the lamp due to sputtering of the emitter material. In addition, blackening of the inner wall surface occurs at the ends of the discharge vessel. If, on the contrary, the percentage of heavy rare gas is too high, the operating voltage increases in the discharge vessel will be relatively small, so that the above-described effects (high current and a heavy and bulky ballast) occur.

Compared with the lamps described in the abovementioned German Offenlegungsschrift, the system efficiency of lamps according to the invention is very favourable. Compared with lamps having approximately the same dimensions, wherein only a relatively heavy rare gas (such as, for example, neon or argon) is present in the discharge vessel, and which have approximately the same luminous flux, lamps according to the invention, can be operated with a stabilization ballast of greatly reduced dimensions and weight. Compact lamps of the type described combine a high luminous flux with a system efficiency which, compared with an incandescent lamp having approximately the same luminous flux, is a few times higher.

Preferably the discharge vessel of the lamp according to the invention contains a rare gas mixture which can be represented by points located at or within the quadrilateral A'B'C'D' in the said ternary diagram, wherein A' represents a mixture consisting of 70% by volume of He and 30% by volume of A and/or Ne, B' represents a mixture consisting of 90% by volume of He and 10% by volume of Kr and/or Xe, C' represents a mixture consisting of 65% by volume of He and 35% by volume of Ce and/or Xe, and D' represents a mixture consisting of 45% by volume of He and 55% by volume of A and/or Ne.

Particularly satisfactory results were obtained with lamps according to the invention wherein the discharge vessel contained a mixture of rare gasses whose composition is represented by points at or within a quadrilateral EFGH in the said ternary diagram, wherein E represents a mixture consisting of 85% by volume of He and 15% by volume of Kr and/or Xe, F a mixture consisting of 70% by volume of He and 30% by volume of Kr and/or Xe and wherein points G and H indicate the mixtures according to E and F with a small quantity (up to approximately 5% by volume) of A and/or Ne being present.

An embodiment of the invention will now be described with reference to the accompanying drawing.

In the drawing,

FIG. 1 shows schematically the ternary diagram PQR already discussed above and FIG. 2 shows schematically and in cross-section an embodiment of a low-pressure mercury vapor discharge lamp according to the invention.

Figure 2:
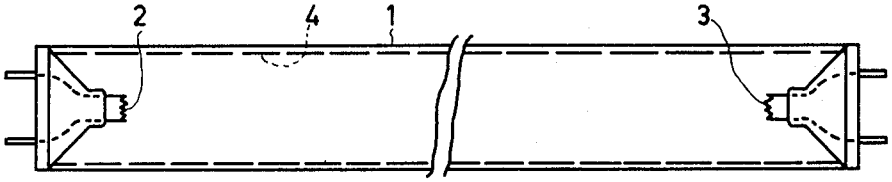

In FIG. 2 reference numberal 1 is the glass tubular discharge vessel of a lamp according to the invention. This tube has a length of less than 40 cm (33 cm) and an inside diameter of less than 20 mm (14.5 mm). Electrodes 2 and 3, between which the discharge is produced during operation of the lamp, are provided one at each end of the discharge vessel. The distance between the electrodes 2 and 3 (column length) is 29 cm. The discharge vessel contains a small quantity of mercury as well as a mixture of helium and crypton at a pressure of 1.5 Torr as the buffer gas. The inner wall surface of the discharge vessel is provided with a luminescent layer 4, consisting of a mixture of two phosphors, namely green-luminescing, terbium-activated cerium magnesium aluminate and red-luminescing trivalent europium-activated yttrium oxide. This luminescent layer can be provided on the inner wall surface of the discharge vessel in a customary manner, for example by means of a suspension.

A number of experiments were performed using the above-mentioned mixture of rare gases as well as a plurality of other mixtures according to the invention.

The Table shows the results of some of these experiments using a mixture of 75% He, 25% Kr. Also shown are the results of experiments performed on lamps having a discharge vessel of comparable dimensions and the same luminescent material coating on the inner wall surface and containing solely argon as the rare gas.

TABLE

| Lamp No. | rare gas(ses) | column length (cm) | inside diam. (mm) | output (lumen) | current (mA) | $V_{lamp}$ (V) | lamp power (Watt) | lamp eff. (lm/W) | V.A. coil | coil power (Watt) | system eff. (lm/W) |
|---|---|---|---|---|---|---|---|---|---|---|---|
| 1 | He-Kr 75-25 | 29 | 14.5 | 1000 | 160 | 120 | 16.9 | 59 | 24 | 3.7 | 48 |
| 2 | A | 29 | 14.5 | 1000 | 270 | 60 | 13.6 | 74 | 53 | 7.0 | 49 |
| 3 | He-Kr 75-25 | 24 | 14.5 | 1000 | 207 | 100 | 18.2 | 55 | 35 | 5.0 | 43 |
| 4 | A | 24 | 14.5 | 1000 | 415 | 48 | 16.2 | 63 | 85 | 10.5 | 38 |
| 5 | He-Kr 75-25 | 25 | 10.3 | 1000 | 175 | 120 | 17.9 | 56 | 26 | 4.0 | 46 |
| 6 | A | 25 | 10.3 | 1000 | 320 | 55 | 14.2 | 70 | 65 | 8.3 | 45 |
| 7 | He-Kr 50-50 | 29 | 14.5 | 1000 | 215 | 87 | 15.8 | 63 | 39 | 5.4 | 47 |
| 8 | He-Kr 65-35 | 29 | 14.5 | 1000 | 180 | 104 | 16.2 | 62 | 30 | 4.4 | 48 |
| 9 | He-Kr 85-15 | 29 | 14.5 | 1000 | 130 | 136 | 15.4 | 65 | 17 | 3.0 | 54 |
| 10 | He-Ne 25-75 | 29 | 14.5 | 1000 | 175 | 104 | 16.3 | 61 | 29 | 4.3 | 49 |
| 11 | He-Xe 90-10 | 29 | 14.5 | 1000 | 165 | 120 | 17.4 | 58 | 25 | 3.9 | 47 |
| 12 | He-A 65-35 | 29 | 14.5 | 1000 | 160 | 112 | 17.0 | 59 | 26 | 3.9 | 48 |
| 13 | He-A 80-20 | 29 | 14.5 | 1000 | 145 | 136 | 17.0 | 59 | 19 | 3.2 | 49 |
| *14 | He-A 45-55 | 29 | 14.5 | 1000 | 185 | 111 | 17.8 | 56 | 30 | 4.4 | 47 |
| 15 | He-A 45-55 | 29 | 14.5 | 1000 | 185 | 99 | 15.7 | 61 | 32 | 4.6 | 49 |
| 16 | He-Kr-A 70-15-15 | 29 | 14.5 | 1000 | 160 | 110 | 15.6 | 64 | 26 | 4.0 | 51 |
| 17 | He-Kr-Ne 50-10-40 | 29 | 14.5 | 1000 | 160 | 105 | 15.3 | 65 | 27 | 4.0 | 49 |
| 18 | He-Kr-Ne 50-40-10 | 29 | 14.5 | 1000 | 200 | 86 | 15.1 | 66 | 36 | 5.1 | 49 |
| 19 | He-Kr-Ne 20-20-60 | 29 | 14.5 | 1000 | 200 | 78 | 13.7 | 73 | 38 | 5.2 | 53 |
| 20 | Ne-Kr 80-20 | 29 | 14.5 | 1000 | 240 | 64 | 13.4 | 75 | 47 | 6.3 | 51 |
| *21 | He-Kr 85-15 | 29 | 14.5 | 1000 | 155 | 155 | 21.0 | 47 | 16 | 2.8 | 42 |
| *22 | He-Kr 75-25 | 29 | 14.5 | 1000 | 170 | 134 | 19.8 | 51 | 23 | 3.6 | 43 |
| *23 | He-A 80-20 | 29 | 14.5 | 1000 | 140 | 154 | 18.1 | 55 | 14 | 2.7 | 48 |
| *24 | He-Xe 85-15 | 21.5 | 14.5 | 1000 | 220 | 120 | 23.2 | 43 | 33 | 4.8 | 36 |
| 25 | A (3 torr) | 34 | 24 | 2000 | 780 | 46 | 30.3 | 66 | 156 | 18.3 | 41 |
| 26 | He-Kr 75-25 | 34 | 24 | 2000 | 420 | 101 | 38.0 | 53 | 72 | 9.0 | 42 |

TABLE

| Lamp No. | rare gas(ses) | | column length (cm) | inside diam. (mm) | output (lumen) | current (mA) | $V_{lamp}$ (V) | lamp power (Watt) | lamp eff. (lm/W) | V.A. coil | coil power (Watt) | syst. eff. (lm/W) |
|---|---|---|---|---|---|---|---|---|---|---|---|---|
| I | He-Kr | 75-25% | 29 | 14.5 | 1000 | 160 | 120 | 16.9 | 59 | 24 | 3.7 | 48 |
| II | A | | 29 | 14.5 | 1000 | 270 | 60 | 13.6 | 74 | 53 | 7.0 | 49 |
| III | He-Kr | 75-25% | 24 | 14.5 | 1000 | 207 | 100 | 18.2 | 55 | 35 | 5.0 | 43 |
| IV | A | | 24 | 14.5 | 1000 | 415 | 48 | 16.2 | 63 | 85 | 10.5 | 38 |
| V | He-Kr | 75-25% | 25 | 10.3 | 1000 | 175 | 120 | 17.9 | 56 | 26 | 4.0 | 46 |
| VI | A | | 25 | 10.3 | 1000 | 320 | 55 | 14.2 | 70 | 65 | 8.3 | 45 |

In the Table lamps according to the invention, for example 1,3,4,5, are compared with lamps having the same length (29, 24 and 25 cm) and inside diameters (14.5 and 10.3 mm) and the same luminous efficacy (approximately 1000 lumen), the discharge vessel containing argon (2, 4 and 6) In this table, an * indicates a lamp containing a rare gas mixture at a pressure of 2.5 Torr. The other lamps contain a rare gas mixture at a pressure of 1.5 Torr. The table shows that the efficiency of the conversion of electric power into UV-radiation in the discharge vessel is higher for lamps filled with argon than for lamps filled with helium and krypton mixtures according to the invention and that the so-called V.A. value of the ballast (the product of the rms voltage across the ballast and the current therethrough) is considerably lower for lamps according to the invention than in lamps containing argon as their buffer gas. The volume of the ballast is substantially proportional to the V.A. value. This means that the volume of the ballast for lamps according to the invention is much smaller than for lamps filled with argon (lamps 2, 4 and 6). Also the power losses in the ballast depend highly on the V.A. value as appears from the Table. The system efficiency of the lamps 1 and 2 is substantially the same, the volume of the ballast for lamp 1 being, however, much smaller than for lamp 2. If lamp 3 is compared with lamp 4 (or lamp 5 with lamp 6) it appears that the system efficiency of lamp 3 is more favourable than of lamp 4. So, when the length of the discharge path is shortened, the system efficiency of a lamp according to the invention becomes more favorable than the system efficiency of the known lamp, having the same length and being filled with argon. The table also shows that the V.A. value increases according as the percentage of He in the rare gas mixture is lower. Lamps containing those mixtures have a ballast of a larger size. Thus, the V.A. value for lamps 9, 13, 21 and 23 is relatively low. Mixtures which are poor in He, on the contrary, result in lamps having a relatively high V.A. value. Lamps no. 7, 14, 15 and 18 are examples of such lamps. Lamps containing a rare gas mixture of only relatively heavy rare gasses (no. 20) have a high V.A. value. When, for example, lamps no. 25 and 26 (see Table) are compared (lamp 25 containing argon at a pressure of 3 Torr, lamp 26 containing He-Kr 75-25 at a pressure of 1.5 Torr), it appears that, in a lamp according to the invention (26) the power consumed by the ballast is so low, compared to the known lamp (25), that at the same system efficiency (approx. 42 lm/W), the volume of a ballast operated by means of a lamp according to the invention is relatively small and the weight relatively low.

What is claimed is:

1. A low-pressure mercury vapor discharge lamp having a tubular discharge vessel which is closed in a vacuum-tight manner and having electrodes which are less than 40 cm apart, the inside diameter of this discharge vessel being less than 26 mm and a luminescent layer provided on the inner wall surface of the discharge vessel, the discharge vessel containing mercury and a mixture of rare gasses, characterized in that the rare gas mixture comprises helium and at least one of the elements neon, argon, krypton and xenon, the composition of the rare gas mixture being represented by means of points located at or within a quadrilateral ABCD in a ternary composition diagram PQR in which P represents helium, Q neon and/or argon, and R krypton and/or xenon, and wherein A indicates a mixture consisting of 80% by volume of helium and 20% by volume of neon and/or argon, B indicates a mixture consisting of 95% by volume of helium and 5% by volume of crypton and/or xenon, C indicates a mixture consisting of 50% by volume of helium and 50% by volume of krypton and/or xenon, and D indicates a mixture consisting of 25% by volume of helium and 75% by volume of neon and/or argon.

2. A low-pressure mercury vapor discharge lamp as claimed in claim 1, characterized in that the discharge vessel comprises a rare gas mixture which is representable by means of points located at or within the quadrilateral A'B'C'D' in the ternary composition diagram, shown in the accompanying drawing.

3. A low-pressure mercury vapor discharge lamp as claimed in claim 1 or 2, characterized in that the discharge vessel comprises a mixture of rare gases whose composition is shown at or within the quadrilateral EFGH in the ternary composition diagram, shown in the accompanying drawing.

* * * * *